US011807013B2

(12) United States Patent
Asanuma

(10) Patent No.: US 11,807,013 B2
(45) Date of Patent: Nov. 7, 2023

(54) PRESSURE VARIATION SUPPRESSOR AND IMAGE FORMING APPARATUS

(71) Applicant: Konica Minolta, Inc., Tokyo (JP)

(72) Inventor: Tasuku Asanuma, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 141 days.

(21) Appl. No.: 17/387,437

(22) Filed: Jul. 28, 2021

(65) Prior Publication Data

US 2022/0032639 A1 Feb. 3, 2022

(30) Foreign Application Priority Data

Jul. 28, 2020 (JP) ..... 2020-127446

(51) Int. Cl.

| | |
|---|---|
| ***B41J 2/175*** | (2006.01) |
| ***B41J 2/045*** | (2006.01) |
| ***B41J 2/14*** | (2006.01) |
| *B41J 2/18* | (2006.01) |

(52) U.S. Cl.

CPC ..... *B41J 2/175* (2013.01); *B41J 2/04501* (2013.01); *B41J 2/14201* (2013.01); *B41J 2/17566* (2013.01); *B41J 2/18* (2013.01); *B41J 2002/14338* (2013.01)

(58) Field of Classification Search

CPC ..... B41J 2/175; B41J 2/17566; B41J 29/38; B41J 2/04501; B41J 2002/14338; B41J 2/14201; B41J 2/18; B41J 2/17593; B41J 2/17596; B41J 2/17503; B41J 2/17563

See application file for complete search history.

(56) References Cited

FOREIGN PATENT DOCUMENTS

| | | | | |
|---|---|---|---|---|
| JP | 2014226811 A | | 12/2014 | |
| KR | 2004-0085026 | * | 10/2004 | ..... B41J 2/17556 |

* cited by examiner

*Primary Examiner* — Kristal Feggins

(74) *Attorney, Agent, or Firm* — CANTOR COLBURN LLP

(57) ABSTRACT

A pressure variation suppressor includes: a liquid flow chamber through which liquid flows, the liquid flow chamber having an inlet through which the liquid flows in and an outlet through which the liquid flows out; and a flexible film that partitions the liquid flow chamber into a storage chamber in which the liquid is stored and a non-storage chamber in which the liquid is not stored, wherein the flexible film is slack in a state where the liquid flows through the liquid flow chamber.

13 Claims, 8 Drawing Sheets

PRESSURE VARIATION SUPPRESSOR AND IMAGE FORMING APPARATUS

CROSS-REFERENCE TO RELATED APPLICATIONS

The present invention claims priority under 35 U.S.C. § 119 to Japanese Patent Application No. 2020-127446, filed on Jul. 28, 2020, the entire content of which is incorporated herein by reference.

BACKGROUND

Technological Field

The present invention relates to a pressure variation suppressor and an image forming apparatus.

Description of the Related Art

Conventionally, an inkjet image forming apparatus that forms an image on a recording medium by ejecting ink from an inkjet head is known.

In addition, a relatively large inkjet image forming apparatus includes an ink supply device or system which is provided with an ink flow path for conveying ink by connecting a plurality of ink tanks storing ink using a pipe and which supplies ink to an inkjet head from an upstream main tank through a flow path such as an intermediate tank.

As an example, there is an ink supply device that stores ink in a main tank located on the most upstream side, conveys the ink in the main tank to several sub tanks during printing, and supplies the ink from the sub tanks to a plurality of inkjet heads via respective flow paths (see, for example, JP 2014-226811 A).

Meanwhile, in an inkjet image forming apparatus using the ink supply device as described above, the following events occur due to a variation in liquid pressure due to the movement of a carriage. For example, ink may leak from the nozzle, or conversely, air may enter into the nozzle.

The occurrence of such event based on the variation in liquid pressure (ink pressure) as described above induces deterioration of image quality. Therefore, a device (hereinafter, referred to as a "pressure variation suppressor") for suppressing variation in ink pressure has been conventionally disposed at an appropriate position of the ink flow path.

Here, as a specific example of the conventional pressure variation suppressor, such a configuration is known in which, for example, a film having flexibility (hereinafter also referred to as a flexible film) is disposed in an ink flow path to absorb a variation in liquid pressure by the flexible film that constitutes a part of the flow path, in other words, a damper function is provided to the flexible film.

However, such a conventional pressure variation suppressor is configured on the premise that tension is constantly applied to the flexible film disposed in the ink flow path, and it is necessary to process the flexible film while controlling the volume of spaces partitioned by the flexible film. Therefore, there is difficulty in producing such a conventional pressure variation suppressor.

Further, the conventional pressure variation suppressor entails a problem that, when a heated liquid such as UV curable ink is used, the volume expands or the damper function is not properly exhibited, due to extension of the flexible film by the heat of the ink.

SUMMARY

An object of the present invention is to provide a pressure variation suppressor and an image forming apparatus that are easy to manufacture and can normally exhibit a damper function even when a heated liquid is used.

To achieve the abovementioned object, according to an aspect of the present invention, a pressure variation suppressor reflecting one aspect of the present invention comprises: a liquid flow chamber through which liquid flows, the liquid flow chamber having an inlet through which the liquid flows in and an outlet through which the liquid flows out; and a flexible film that partitions the liquid flow chamber into a storage chamber in which the liquid is stored and a non-storage chamber in which the liquid is not stored, wherein the flexible film is slack in a state where the liquid flows through the liquid flow chamber.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
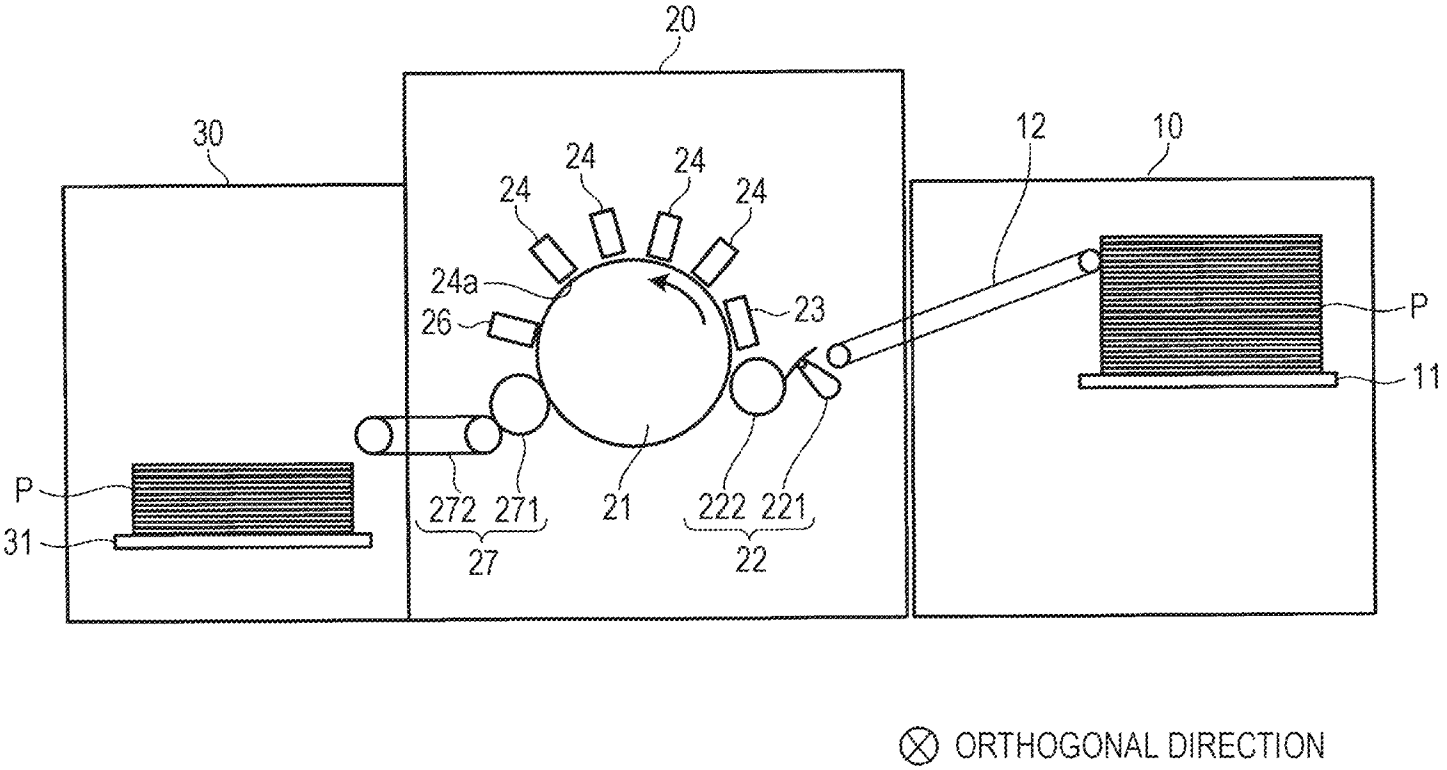
FIG. 1 is a diagram illustrating a schematic configuration of an image forming apparatus according to an embodiment of the present invention.

FIG. 1 is a diagram illustrating a schematic configuration of an image forming apparatus 1 according to the present embodiment.

The image forming apparatus 1 includes a sheet feeder 10, an image former 20, a sheet receiver 30, a controller 40 (see FIG. 2), and the like. Under the control of the controller 40, the image forming apparatus 1 conveys a recording medium P stored in the sheet feeder 10 to the image former 20, forms an image on the recording medium P by the inkjet type image former 20, and conveys (discharges) the recording medium P on which the image is formed to the sheet receiver 30.

As the recording medium P, various media on which ink impacted on the surface can be fixed, such as fabric or sheet-shaped resin, can be used in addition to paper such as plain paper or coated paper.

The sheet feeder 10 includes a sheet feeding tray 11 that stores the recording medium P, and a medium carrier 12 that conveys and feeds the recording medium P from the sheet feeding tray 11 to the image former 20.

The sheet feeding tray 11 is a plate-shaped member on which one or a plurality of recording media P can be placed. The sheet feeding tray 11 is provided to move up and down according to an amount of the recording media P placed on the sheet feeding tray 11, and is held at a position where the uppermost recording medium P is conveyed by the medium carrier 12 in the direction of vertical movement.

The medium carrier 12 is equipped with a loop-shaped belt. The inner face of the belt is supported by two rollers. When the rollers are rotated with the recording medium P placed on the belt, the recording medium P is conveyed from the sheet feeding tray 11 to the image former 20.

The image former 20 includes a conveyance drum 21, a relay unit 22, a medium heater 23, head units 24, a fixing unit 26, and a delivery unit 27.

The conveyance drum 21 rotates around a rotation axis extending in a direction (hereinafter referred to as "orthogonal direction") perpendicular to the page of FIG. 1 while holding the recording medium P on an outer peripheral curved surface (conveyance surface) which is a cylindrical surface, thereby conveying the recording medium P in a conveyance direction along the conveyance surface (see an arrow in FIG. 1).

The conveyance drum 21 includes a claw and a suction unit (not illustrated) for holding the recording medium P on the conveyance surface. The recording medium P is pressed by the claw at its end, and attracted to the conveyance surface by the suction unit. Thus, the recording medium P is held on the conveyance surface.

The conveyance drum 21 includes a conveyance drum motor (not illustrated) for rotating the conveyance drum 21, and rotates by an angle proportional to the rotation amount of the conveyance drum motor. The conveyance drum 21 and the conveyance drum motor have a function of conveying the recording medium P with the recording medium P facing inkjet heads 242 (see FIG. 2 and FIG. 3A to FIG. 3C) of the head units 24.

The relay unit 22 delivers the recording medium P conveyed by the medium carrier 12 of the sheet feeder 10 to the conveyance drum 21. The relay unit 22 is disposed between the medium carrier 12 of the sheet feeder 10 and the conveyance drum 21. The relay unit 22 receives one end of the recording medium P conveyed from the medium carrier 12 at a swing arm 221 and delivers the recording medium P to the conveyance drum 21 via a delivery drum 222.

The medium heater 23 is disposed between the delivery drum 222 and the head unit 24, and heats the conveyance surface of the conveyance drum 21 and the recording medium P so that the recording medium P conveyed by the conveyance drum 21 has a temperature within a predetermined range.

Figure 2:
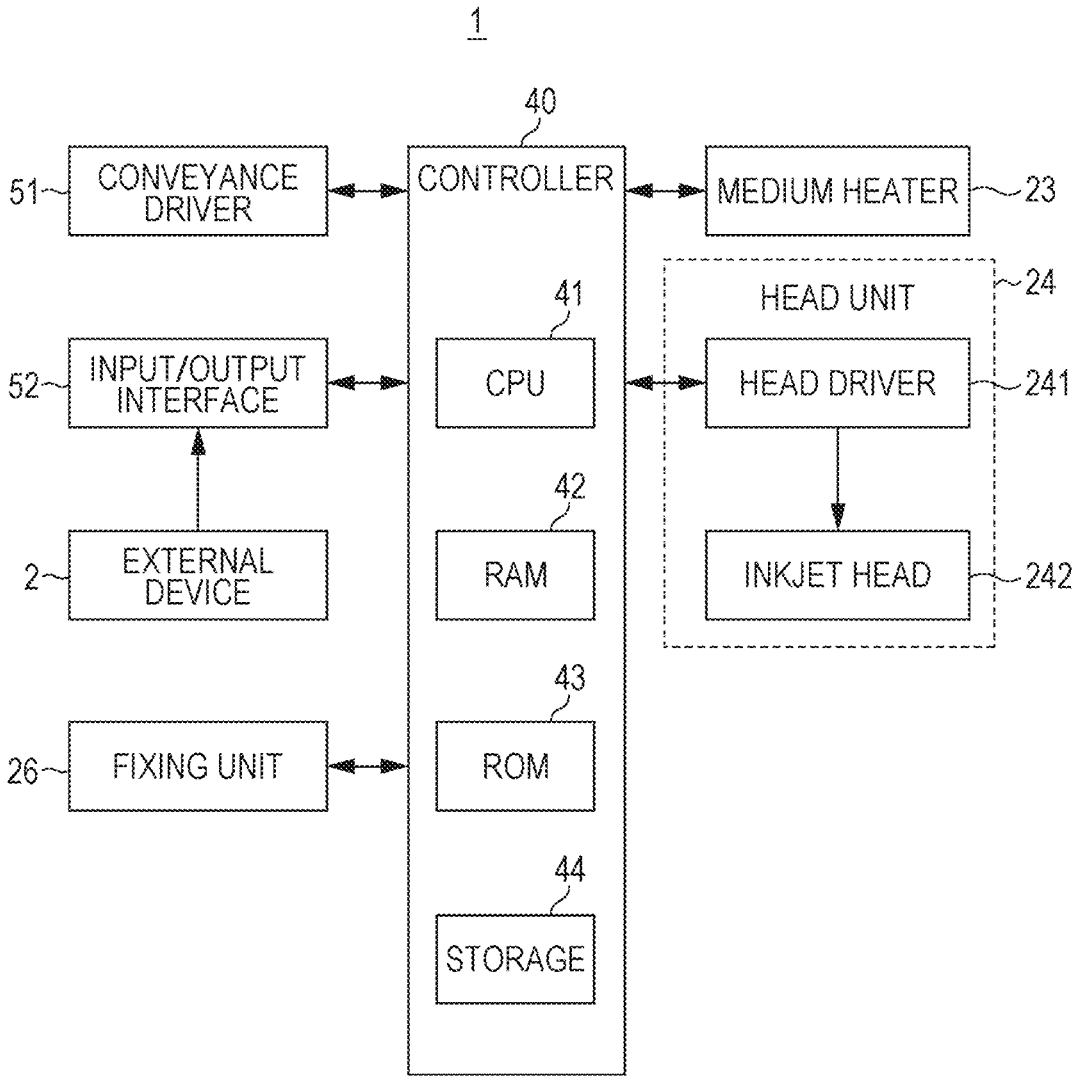
FIG. 2 is a block diagram illustrating a main functional configuration of the image forming apparatus according to the embodiment.

The medium heater 23 includes, for example, an infrared heater, and causes the infrared heater to generate heat by supplying electric power to the infrared heater on the basis of a control signal supplied from the controller 40 (see FIG. 2).

The head units 24 eject ink onto the recording medium P from nozzle openings (hereinafter, referred to as "nozzles") provided on ink ejection surfaces facing the conveyance surface of the conveyance drum 21 at an appropriate timing according to the rotation of the conveyance drum 21 carrying the recording medium P, and record (form) an image. The head units 24 are disposed such that ink ejection surfaces (hereinafter referred to as "nozzle surfaces 24*a*") are separated from the conveyance surface with a predetermined gap.

The image forming apparatus 1 according to the present embodiment includes four head units 24 corresponding to inks of four colors of Y (yellow), M (magenta), C (cyan), and K (black). These head units 24 are disposed at predetermined intervals in the order of Y, M, C, and K from the upstream side in the conveyance direction of the recording medium P.

Each head unit 24 includes an inkjet head 242 (see FIG. 2). The inkjet head 242 is provided with a plurality of recording elements each including a pressure chamber that stores ink, a piezoelectric element provided on a wall surface of the pressure chamber, and a nozzle. When the recording element receives a drive signal for deforming the piezoelectric element, the pressure chamber deforms by the deformation of the piezoelectric element to cause a variation in pressure in the pressure chamber, and thus, the recording element ejects ink from the nozzle communicating with the pressure chamber.

The installation range of the nozzles included in the inkjet head 242 in the orthogonal direction covers the width in the orthogonal direction of a region where the image is formed in the recording medium P conveyed by the conveyance drum 21.

Note that the head units 24 may be of either a single pass type in which their positions are fixed with respect to the rotation axis of the conveyance drum 21 during image formation, or a scan type in which they move along the rotation axis of the conveyance drum 21.

The head units 24 are mounted on a carriage (not illustrated). The carriage is configured to be movable in a predetermined direction by a head moving mechanism (not illustrated).

The head moving mechanism moves the head units 24 as follows under the control of the controller 40. That is, the head moving mechanism moves the nozzle surfaces 24*a* of the inkjet heads 242 to positions (printing region) facing the peripheral surface of the conveyance drum 21 during image formation. On the other hand, during various types of maintenance, the head moving mechanism moves the nozzle surfaces 24*a* of the inkjet heads 242 to positions (maintenance region) facing a cleaning device (not illustrated).

The fixing unit 26 includes a light emitter disposed along the width of the conveyance drum 21 in the orthogonal direction. Under the control of the controller 40, the fixing unit 26 irradiates the recording medium P placed on the conveyance drum 21 with energy rays such as ultraviolet rays from the light emitter. The light emitter of the fixing unit 26 applies predetermined energy to the ink ejected on the recording medium P to cure and fix the ink on the recording medium P.

The delivery unit 27 includes a belt loop 272 having a loop-shaped belt that is internally supported by two rollers, and a cylindrical delivery drum 271 that delivers the recording medium P from the conveyance drum 21 to the belt loop 272. The delivery unit 27 conveys, by the belt loop 272, the recording medium P delivered onto the belt loop 272 from the conveyance drum 21 by the delivery drum 271, and sends the recording medium P to the sheet receiver 30.

The sheet receiver 30 includes a flat sheet receiving tray 31 on which the recording medium P sent from the image former 20 by the delivery unit 27 is placed.

FIG. 2 is a block diagram showing a main functional configuration of the image forming apparatus 1. The image forming apparatus 1 includes the medium heater 23, an inkjet head driver ("head driver" in the figure) 241 and inkjet heads 242 included in the head units 24, the fixing unit 26, the controller 40, a conveyance driver 51, and an input/output interface 52.

The inkjet head driver 241 supplies a drive signal for deforming the piezoelectric elements to the recording elements of the inkjet heads 242 according to image data at an appropriate timing under the control of the controller 40. Thus, ink in an amount corresponding to a pixel value of the image data is ejected from the nozzles of the inkjet heads 242. A plurality of inkjet heads 242 is actually arrayed in the head units 24.

The controller 40 controls the entire image forming apparatus 1, and includes a central processing unit (CPU) 41, a random access memory (RAM) 42, a read only memory (ROM) 43, and a storage 44.

The CPU 41 reads various control programs and setting data stored in the ROM 43, stores them in the RAM 42, and executes the programs to perform various kinds of arithmetic processing. The CPU 41 performs centralized control of the entire operation of the image forming apparatus 1.

The RAM 42 provides a working memory space to the CPU 41 and stores temporary data. The RAM 42 may include a nonvolatile memory.

The ROM 43 stores various control programs executed by the CPU 41, setting data, and the like. Instead of the ROM 43, a rewritable nonvolatile memory such as an electrically erasable programmable read-only memory (EEPROM) or a flash memory may be used.

The storage 44 stores a print job (print command) input from an external device 2 via the input/output interface 52 and image data according to the print job. A hard disk drive (HDD) is used as the storage 44, for example, and a dynamic random access memory (DRAM) or the like may be used in combination.

The conveyance driver 51 supplies a drive signal to the conveyance drum motor of the conveyance drum 21 on the basis of the control signal supplied from the controller 40 so as to rotate the conveyance drum 21 at a predetermined speed and timing. Further, the conveyance driver 51 supplies a drive signal to a motor for driving the medium carrier 12, the relay unit 22, and the delivery unit 27 on the basis of a control signal supplied from the controller 40 so as to feed or discharge the recording medium P to or from the conveyance drum 21.

The input/output interface 52 mediates data communication between the external device 2 and the controller 40. For example, the input/output interface 52 includes any one or combination of a variety of serial interfaces and a variety of parallel interfaces.

The external device 2, which is constituted by a personal computer for example, supplies an image forming command (print job), image data, and the like to the controller 40 though the input/output interface 52.

Although not illustrated, the image forming apparatus 1 includes an ink supply system that stores ink to be used in advance and supplies the ink toward the inkjet heads 242 while adjusting (controlling) the temperature of the ink at the time of printing.

Main elements of the ink supply system include, for example, an ink tank (see an ink tank T illustrated in FIG. 11 as appropriate) that stores ink, an ink heater such as a heater, an intermediate tank, and the like in order from the upstream side of the ink flow path.

Furthermore, in the present embodiment, an ink that changes in phase between a gel state and a liquid state depending on temperature can be used. For example, an energy ray-curable ink such as a UV ink can be used which is in a gel state at normal temperature, changes to a liquid state by being heated, and is solidified by being irradiated with an energy ray during image formation.

Next, problems in a conventional ink supply system and pressure variation suppressor will be described with reference to FIG. 3A to FIG. 3C, FIG. 4A, and FIG. 4B.

Figure 3A:
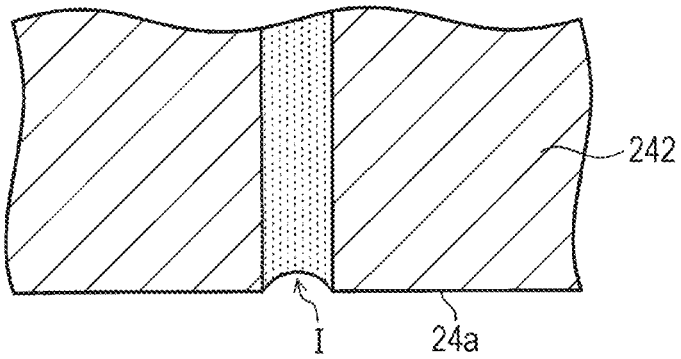
FIG. 3A to FIG. 3C are diagrams for describing the behavior of ink in the vicinity of a nozzle surface of an inkjet head when pressure variation occurs in an ink flow path.
Figure 3B:
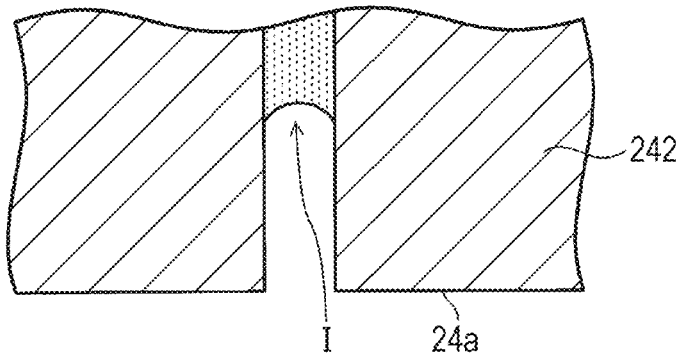
Figure 3C:
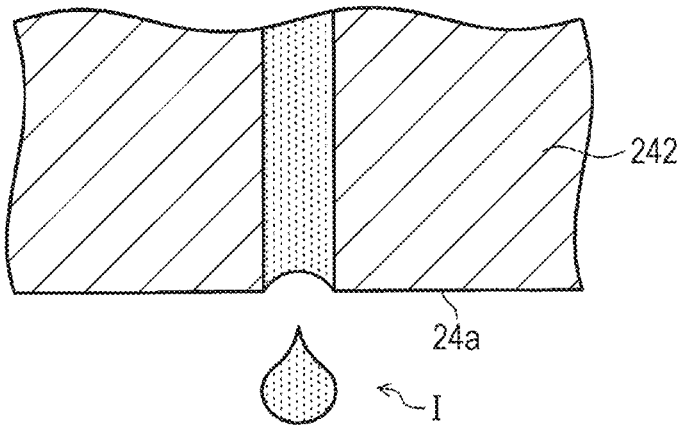

Here, FIG. 3A to FIG. 3C are cutaway cross-sectional views for describing a case where the liquid pressure varies until ink reaches the nozzle surface 24*a* of the inkjet head 242.

FIG. 3A shows a normal state (standby state) before an ink I is ejected from the inkjet head 242. As illustrated in FIG. 3A, in such a standby state, a curved surface (meniscus) of the ink I curved upward at the position of the nozzle surface 24*a* is formed due to an interaction between the surface tension of the liquid and the surface of the nozzle.

At this time, when acceleration is applied to the ink I in the inkjet head 242 due to, for example, movement of the carriage, application of an external force to the head unit 24, or the like, the liquid pressure of the ink I varies, and the meniscus illustrated in FIG. 3A is broken.

At this time, when the liquid pressure of the ink I in the inkjet head 242 varies in the negative direction, the ink I in the inkjet head 242 rises, and air enters the nozzle as shown in FIG. 3B, thus causing ejection failure during printing.

Conversely, when the liquid pressure of the ink I in the inkjet head 242 varies in the positive direction, the ink I may leak from the nozzle as shown in FIG. 3C, which may cause problems such as contamination of the recording medium P and the components of the apparatus.

In order to prevent the movement of the ink I and deterioration of the image quality based on the variation of the liquid pressure (ink pressure) as described above, a pressure variation suppressor for suppressing pressure variation of the ink I has conventionally been disposed at an appropriate position of the ink flow path from the upstream ink tank to the inkjet head 242.

More specifically, it is known that the meniscus of ink is broken as shown in FIG. 3B and FIG. 3C when the ink pressure in the nozzle part falls outside a predetermined range. Therefore, the following pressure variation suppressor for suppressing the pressure variation of the ink caused by the inertia during the movement of the inkjet head 242 is known. Specifically, this pressure variation suppressor is provided with a film (flexible film) and an elastic body such as a spring in a flow path at the upstream side of the inkjet head 242, and absorbs the pressure variation by a change in volume of the flow path due to the deformation of the flexible film.

A configuration example of the conventional pressure variation suppressor which is provided with a flexible film disposed in an ink flow path and absorbs a liquid pressure by the flexible film constituting a part of the flow path (allows the flexible film to function as a damper) will be described below with reference to FIG. 4A and FIG. 4B.

Figure 4A:
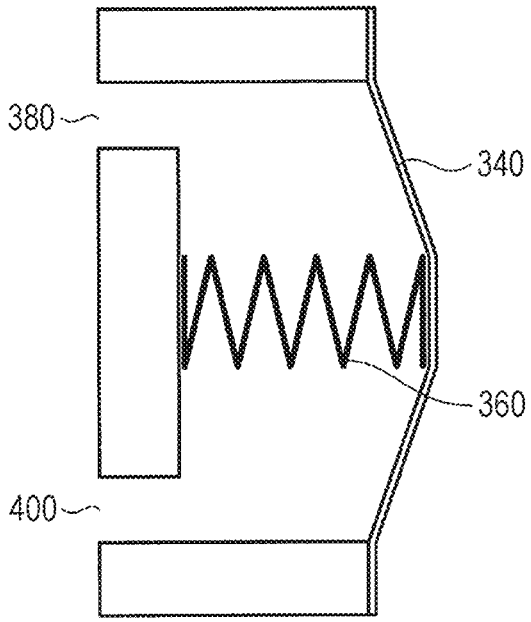
FIG. 4A and FIG. 4B are diagrams for describing a configuration of a conventional pressure variation suppressor.

FIG. 4A is a schematic diagram illustrating an example of the conventional pressure variation suppressor. This pressure variation suppressor is provided with a flexible film 340 in the ink flow path and a spring 360 that is attached to a member defining an entrance (inlet 380) and an exit (outlet 400) of the flow path and that presses the central part of the flexible film 340.

In the pressure variation suppressor described above, the ink I flowing in through the inlet 380 moves along a flow path defined by the flexible film 340 and a peripheral member that fixes edges of the flexible film 340, flows out through the outlet 400, and is supplied to the inkjet head 242.

When acceleration is applied to the ink I in the inkjet head 242 as described above, the flexible film 340 serves as a damper that absorbs the liquid pressure variation, so that the occurrence of the abovementioned problems can be prevented or suppressed.

Specifically, when the liquid pressure (back pressure) of the ink I in the inkjet head 242 varies in the negative direction, the flexible film 340 is deformed in a direction in which the tension thereof is decreased to cause more ink to flow out through the outlet 400, so that the intrusion of air into the nozzle as described in FIG. 3B can be prevented or suppressed.

Conversely, when the liquid pressure of the ink I in the inkjet head 242 varies in the positive direction, the flexible film 340 is deformed in a direction in which the tension thereof is increased to suction ink through the outlet 400, so that the leakage of ink from the nozzle as described in FIG. 3C can be prevented or suppressed.

On the other hand, the configuration as shown in FIG. 4A has a problem that, since the spring 360 extends and compresses in the flow path of the ink I, the polymerization of the ink I is accelerated by the sliding movement of the spring 360 and a support member thereof depending on the physical properties of the ink I, which immobilizes the spring 360 (mechanochemical reaction). In addition, there is a problem that the inside of the image forming apparatus is contaminated by the ink I when the flexible film 340 is broken for some reason.

Figure 4B:
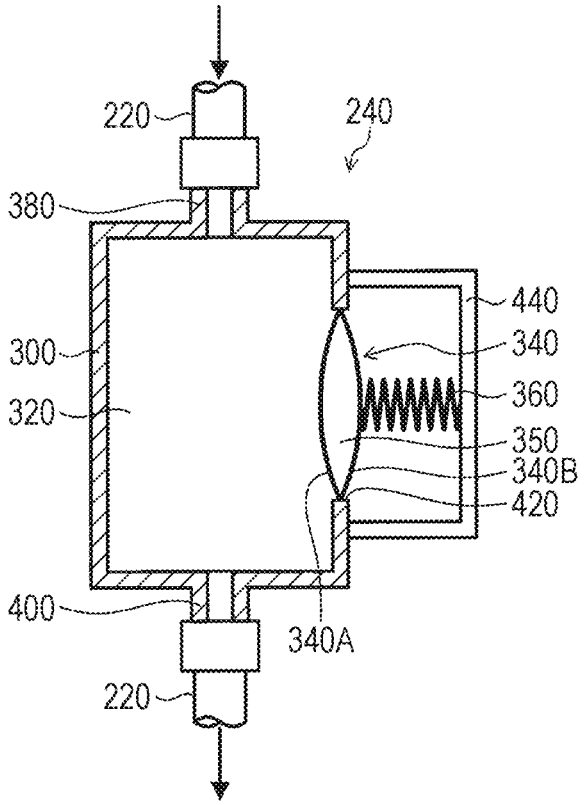

FIG. 4B is a schematic diagram illustrating another example of the conventional pressure variation suppressor. The pressure variation suppressor 240 is configured to be able to overcome the above problem by providing the spring 360 that presses the flexible film 340 outside the ink flow path.

The pressure variation suppressor 240 illustrated in FIG. 4B includes a housing 300 which has an inlet 380 and an outlet 400 through which ink flows and which has an ink chamber 320 formed therein, a flexible film 340 constituting a part of a wall surface of the ink chamber 320, a spring 360 that holds the flexible film 340, a support frame 440 that supports the spring 360, and the like.

Among the above components, the inlet 380 is connected to a pipe 220 connected to an ink tank (not shown), and the outlet 400 is connected to a pipe 220 connected to an inkjet head (not shown). The housing 300 (ink chamber 320) has a cuboid shape, and a disk-shaped flexible film 340 is attached to a circular opening 420 formed in a part of a wall surface of the housing 300.

The flexible film 340 includes two flexible film bodies 340A and 340B which overlap each other. The two film bodies 340A and 340B are joined and integrated at the peripheral edges, and a sealed air layer 350 is formed therebetween with a predetermined capacity (volume). The elastic force of the flexible film 340 (elastic force of a surface constituting one wall surface of the ink chamber 320) is determined by the volume of the air layer 350.

The spring 360 is a coil spring, and extends and compresses to hold the flexible film 340 in a displaceable manner. The spring 360 is disposed outside the ink chamber 320 and is located perpendicular to the wall surface of the ink chamber 320 to which the flexible film 340 is attached. Specifically, one end of the spring 360 is connected to the central part of the outer film body 340B of the two film bodies 340A and 340B constituting the flexible film 340, and the other end of the spring 360 is connected to the support frame 440.

The spring 360 is set to have an elastic force that allows the flexible film 340 to be located at a predetermined initial position when the ink flows into the ink chamber 320. Here, the initial position indicates a position where the force of the ink, which has flown into the ink chamber 320, toward the inkjet head by its own weight and the force of the spring 360 for holding the position of the film surface of the flexible film 340 are balanced and a state where a constant negative pressure is generated can be maintained.

According to the pressure variation suppressor 240 described above, the back pressure of the inkjet head can be adjusted by holding the flexible film 340 at a fixed position by the spring 360. Furthermore, when pressure variation in the ink flow path occurs, the pressure variation suppressor 240 can suppress the pressure variation by the flexible film 340 functioning as a damper for absorbing the pressure variation due to the deformation of the flexible film 340 as in the configuration described with reference to FIG. 4A.

In general, the pressure variation suppressor 240 illustrated in FIG. 4B prevents the contact between the ink and the spring 360 by providing the spring 360 outside the ink flow path, thereby solving the problem that the spring 360 is immobilized due to the physical properties of the ink I.

Further, in the pressure variation suppressor 240, the flexible film 340 includes a plurality of film bodies (340A and 340B), and thus, even when one (340A or 340B) of the film bodies is damaged, the other film body (340B or 340A) can prevent the ink I from flowing to the outside.

On the other hand, in the pressure variation suppressor 240 having such a configuration, the elastic force of the flexible film 340 having a damper function is determined by the volume of the air layer 350 between the film bodies (340A and 340B), and therefore, volume control of the air layer 350 is an important problem.

In this regard, when the configuration as shown in FIG. 4B is adopted, it is necessary to process film bodies (340A and 340B) such as films while controlling the volume of the air layer 350 during manufacture, and thus, there arises a problem that manufacture is difficult.

Furthermore, when a heated liquid such as UV curable ink is used, there is a problem that the air layer 350 expands by the heat of the flowing ink I, resulting in that the damper function of the flexible film 340 is not correctly exhibited.

Furthermore, when the configuration in which the spring 360 is disposed outside the ink flow path as illustrated in FIG. 4B is employed, the spring 360 needs to serve as a tension spring that pulls the outer film body 340B. In this case, it is necessary to fix (bond or weld) the film body 340B and the spring 360 (tension spring), and there is a production problem or durability problem regarding such fixation.

The inventors of the present invention have conducted intensive studies in order to solve the problems of the background art as described above, and such intensive studies lead to a proposal of a configuration of a pressure variation suppressor that has a simple configuration easy to manufacture and can effectively suppress a variation in liquid pressure by normally exerting a damper function even when heated liquid flows.

The configuration of the pressure variation suppressor according to the present embodiment will be described below in detail with reference to FIG. 5A and subsequent drawings.

Figure 5A:
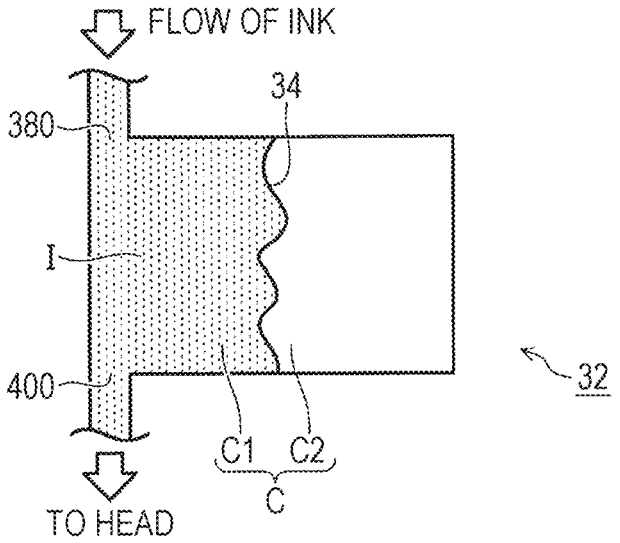
FIG. 5A to FIG. 5C are diagrams for describing a basic configuration and operation of the pressure variation suppressor according to the embodiment.
Figure 5B:
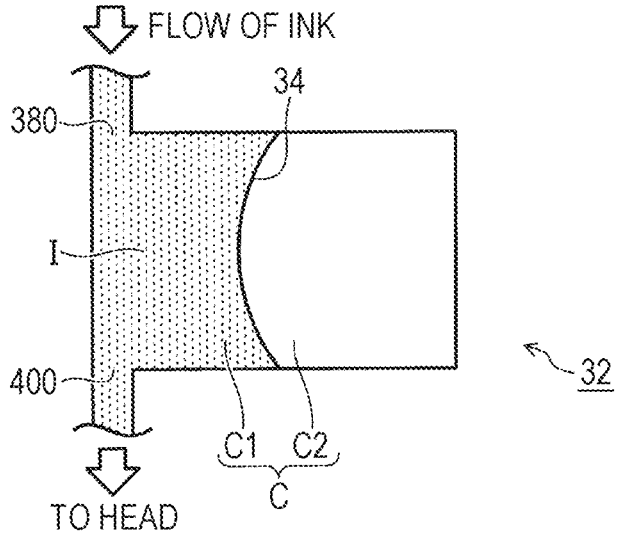
Figure 5C:
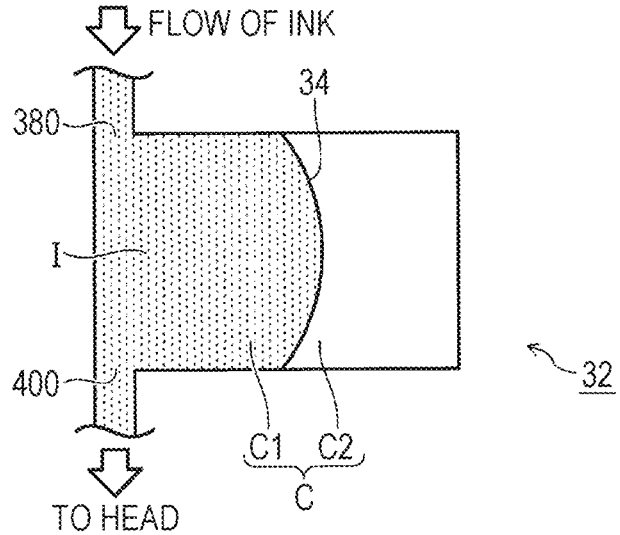

FIG. 5A to FIG. 5C illustrate a first configuration example of the pressure variation suppressor according to the present embodiment. FIG. 5A to FIG. 5C are diagrams for describing a basic configuration and operation of the present embodiment.

As illustrated in FIG. 5A, a pressure variation suppressor 32 according to the present embodiment includes a liquid flow chamber C through which ink I (liquid) flows, the liquid flow chamber C having an inlet 380 through which the ink I flows in and an outlet 400 through which the ink I flows out, and a flexible film 34 that partitions the liquid flow chamber C into a storage chamber C1 in which the ink I is stored or flows and a non-storage chamber C2 in which the ink I is not stored. The flexible film 34 is slack in a state where the ink I flows through the liquid flow chamber C (storage chamber C1).

In the pressure variation suppressor 32, the inlet 380 is connected to a pipe connected to the ink tank, and the outlet 400 is connected to a pipe connected to the inkjet head 242, as in the configuration described with reference to FIG. 4B.

The liquid flow chamber C is a container-shaped housing (casing), and has a cuboid shape in one specific example. In this case, the rectangular flexible film 34 is fixed to four continuous wall surfaces (inner surfaces) of the cuboid housing.

The housing constituting the liquid flow chamber C is not limited to have the above shape, and may have any shape such as a cylindrical shape. In the following description, the housing and the liquid flow chamber C have a cuboid shape for the sake of convenience.

As the flexible film 34, any flexible material such as a resin film or a rubber film can be used.

In one specific example, the flexible film 34 has a planar shape identical to a rectangular shape (longitudinal cross section of the liquid flow chamber C) defined by four continuous wall surfaces (inner surfaces) of the housing, before being fixed to the housing. Then, after being fixed to the housing (in the liquid flow chamber C), the flexible film 34 is subjected to a predetermined treatment (for example, thermal or mechanical treatment, chemical coating, and the like) so as to be slack in the housing (liquid flow chamber C).

In another example, the flexible film 34 has a rectangular shape which is slightly larger in width or length than the rectangular shape defined by the four continuous wall surfaces (inner surfaces) of the housing, and thus, it is slack when attached and fixed to the housing (in the liquid flow chamber C).

A method for fixing the flexible film 34 to the housing (in the liquid flow chamber C) is not particularly limited, and any method such as welding by heat, laser, or the like, or bonding using an adhesive can be used.

Note that, in order to easily fix the flexible film 34 to the housing (in the liquid flow chamber C), the housing may have a joint structure that can be separated (divided into two) at or near the boundary between the storage chamber C1 and the non-storage chamber C2.

In the pressure variation suppressor 32 according to the present embodiment, when the image forming apparatus 1 is in a standby state or used, that is, during execution of printing in which the ink I flows into the storage chamber C1, an appropriate pressure is applied to the flexible film 34 by the ink I, and thus, the flexible film 34 keeps a slack state as shown in FIG. 5A.

In other words, in the pressure variation suppressor 32 according to the present embodiment, no tension is generated in the flexible film 34 in a normal use state (see FIG. 5A) unlike the conventional art.

Then, in a case where the acceleration of the ink I is applied to the flexible film 34 from the state illustrated in FIG. 5A due to, for example, an unexpected external force or the like, the flexible film 34 is in a state as illustrated in FIG. 5B or 5C, that is, in a state in which the flexible film 34 has no slack, and tension is generated in the flexible film 34.

Here, FIG. 5B illustrates a case where the ink flow path has a negative pressure, that is, a case where a negative acceleration is applied to the flexible film 34 due to the variation in the liquid pressure of the ink I in a negative direction. In this case, the negative pressure is absorbed by the flexible film 34, and thus, the problem as described above with reference to FIG. 3B, that is, the problem of ejection failure due to inclusion of air in the nozzle, is effectively suppressed.

Furthermore, in the state illustrated in FIG. 5B, a force for relaxing the tension is generated in the flexible film 34. Therefore, the flexible film 34 then acts to allow more ink to flow through the inlet 380 on the upstream side of the ink flow path, and returns to the initial position or the normal state as illustrated in FIG. 5A.

On the other hand, FIG. 5C illustrates a case where the ink flow path has a positive pressure, that is, a case where a positive acceleration is applied to the flexible film 34 due to a variation of the liquid pressure of the ink I in a positive direction. In this case as well, the positive pressure is absorbed by the flexible film 34, and thus, the problem as described above with reference to FIG. 3C, that is, the problem of leakage of the ink I from the nozzle, is effectively suppressed.

Furthermore, in the state illustrated in FIG. 5C, a force for relaxing the tension is generated in the flexible film 34. Therefore, the flexible film 34 then acts to temporarily reduce an amount of ink flowing in through the inlet 380, and returns to the initial position or the normal state as illustrated in FIG. 5A.

According to the present embodiment in which the flexible film 34 has the abovementioned behavior, the pressure variation can be absorbed by deformation of the flexible film 34 in either case where the liquid pressure in the ink flow path (ink pressure and the back pressure of the inkjet head 242) increases or decreases.

In the configuration where the flexible film 34 has no slack (is tight) in a normal use state in which the ink I flows into the storage chamber C1, when an acceleration is applied in the direction in which the flexible film 34 is further stretched, the flexible film 34 cannot be further deformed due to the limit of the tension of the flexible film 34.

In view of this, in the present embodiment, it is important to configure or adjust the flexible film 34 to be in a slack state (having no tension) in a normal state where the ink I is flowing through the liquid flow chamber C (storage chamber C1).

According to the present embodiment having the configuration described above, the flexible film 34 is deformed and exhibits the damper function in either case where the ink pressure is increased or decreased from the normal state where the ink I flows into the storage chamber C1.

In addition, according to the present embodiment, the pressure variation suppressor has a simpler configuration than the conventional device, and thus can be manufactured more easily.

From the viewpoint of preventing the ink I from flowing out to the outside even if the flexible film 34 is broken, the non-storage chamber C2 is desirably sealed.

Other configuration examples of the pressure variation suppressor according to the present embodiment will be described below with reference to FIG. 6 to FIG. 11. Note that components equivalent to those of the pressure variation suppressor 32 described above are denoted by the same reference numerals, and the description thereof will be omitted as appropriate.

Figure 6:
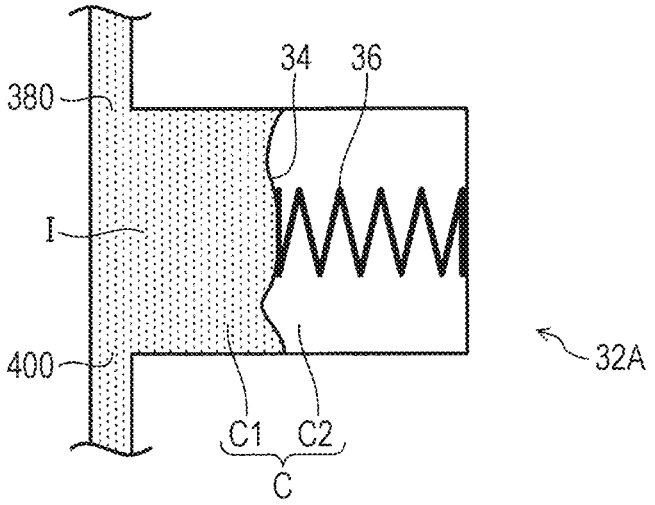
FIG. 6 is a diagram illustrating a second configuration example of the pressure variation suppressor according to the embodiment.

Pressure variation suppressors 32A to 32F respectively having second to seventh configuration examples illustrated in FIG. 6 and the subsequent drawings are provided with a "biasing unit" of the present invention that biases the flexible film 34 toward the ink flow path, that is, the storage chamber C1.

FIG. 6 illustrates the second configuration example of the present embodiment. The pressure variation suppressor 32A illustrated in FIG. 6 is obtained by adding a spring 36 to the configuration of the abovementioned pressure variation suppressor 32, wherein the flexible film 34 is pressed by the spring 36.

In one specific example, the spring 36 is a coil spring, and has one end fixed to a wall surface (an inner surface facing the flexible film 34) defining the non-storage chamber C2 and the other end in contact with a central part of the flexible film 34. The spring 36 corresponds to the "biasing unit" and the "pressing member" of the present invention.

A material of the spring 36 is not particularly limited, and any material such as metal or resin can be used.

The size, pressing force, and the like of the spring 36 are adjusted such that, when the ink I does not flow into (is not stored in) the storage chamber C1, the flexible film 34 is tight with no slack by the biasing force (pressing force) of the spring 36, while in a normal state where the ink I flows into (is stored in) the storage chamber C1, the flexible film 34 is slack (tension is not generated in the flexible film 34).

Then, in the second configuration example, the protruding amount or tension of the flexible film 34 in a state where the ink I is not stored in the storage chamber C1 is controlled by adjusting the biasing force or the like of the spring 36, so that it is possible to control the degree of slack of the flexible film 34 in the state where the ink I is stored in the storage chamber C1, that is, during normal printing. As described above, the damper function of the flexible film 34 can be stabilized by controlling the state of the flexible film 34 using the spring 36.

According to the second configuration example, even when, in the normal use state in which the ink I flows into the storage chamber C1, the flexible film 34 is displaced toward the non-storage chamber C2 due to, for example, a smaller thickness of the flexible film 34 (see FIG. 5C as appropriate), it is possible to slacken the flexible film 34 with the help of the biasing force of the spring 36 in the normal use state (see FIG. 6).

Further, according to the second configuration example in which the biasing unit is constructed using the spring 36 (coil spring), the flexible film 34 can be pressed with a simple and inexpensive configuration. Further, the flexible film 34 can be uniformly pressed by pressing the central part of the surface of the flexible film 34 with the spring 36 (coil spring).

As a further modification, it is also conceivable to additionally or alternatively dispose the spring 36 in the storage chamber C1. However, in a case where the ink I to be used is UV curable ink or the like, it is considered that the abovementioned problem occurs, and thus, it is desirable to provide the spring 36 only in the non-storage chamber C2.

Figure 7:
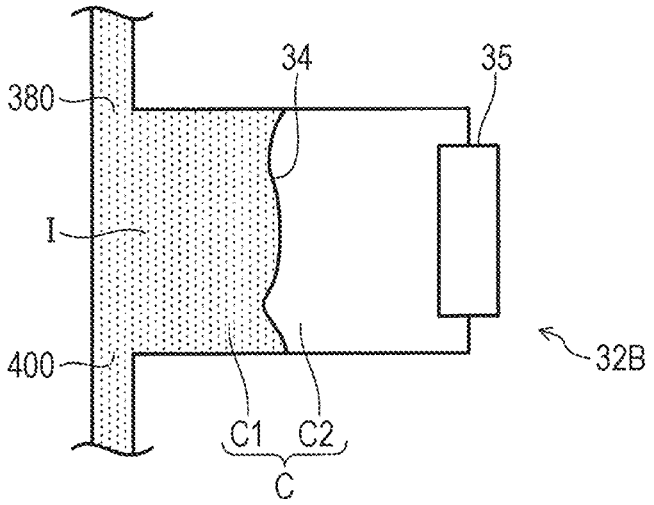
FIG. 7 is a diagram illustrating a third configuration example of the pressure variation suppressor according to the embodiment.

FIG. 7 illustrates the third configuration example of the present embodiment. The pressure variation suppressor 32B illustrated in FIG. 7 is obtained by adding a pressure adjuster 35 to the configuration of the pressure variation suppressor 32 described above, and is configured to bias the flexible film 34 toward the storage chamber C1 using a pressure of gas by the pressure adjuster 35.

In the example illustrated in FIG. 7, the pressure adjuster 35 is provided on a wall surface (a surface facing the flexible film 34) of a casing that defines the non-storage chamber C2. More specifically, an opening is formed in the wall surface, and the pressure adjuster 35 is fitted and fixed in the opening. Thus, the non-storage chamber C2 is sealed.

The pressure adjuster 35 is provided with an air pressure sensor that outputs a detection signal to the controller 40 described above, a pressure pump driven by the control of the controller 40, and the like. The pressure pump is driven under the control of the controller 40 so that the air pressure in the non-storage chamber C2 is a predetermined pressure.

More specifically, the operating state of the pressure pump of the pressure adjuster 35 is controlled such that, when the ink I does not flow into (is not stored in) the storage chamber C1, the flexible film 34 is tight with no slack by the pressure (biasing force) of the gas due to the operation of the pressure adjuster 35, while in a normal state where the ink I flows into (is stored in) the storage chamber C1, the flexible film 34 is slack (tension is not generated in the flexible film 34).

Thus, the pressure adjuster 35 and the controller 40 correspond to the "biasing unit" of the present invention.

According to such a configuration, it is possible to obtain an effect equivalent to that of the pressure variation suppressor 32A described with reference to FIG. 6. Furthermore, in the pressure variation suppressor 32B illustrated in FIG. 7, the pressure adjuster 35 presses the flexible film 34 without contacting the flexible film 34, and thus, it is possible to more reliably slacken the flexible film 34 in a normal use state in which the ink I flows (is stored) in the storage chamber C1.

In addition, the pressure variation suppressor 32B can also provide an effect equivalent to that of the configuration which has the spring 36 disposed in the storage chamber C1 by controlling, as necessary, the pressure pump so that the inside of the non-storage chamber C2 has a negative pressure.

Figure 8:
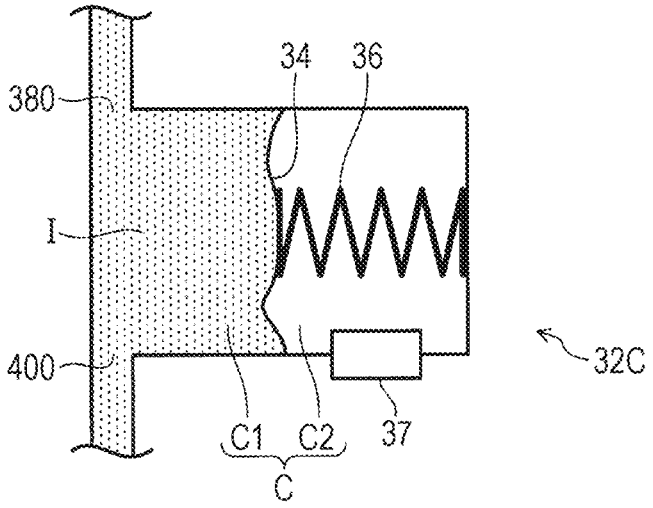
FIG. 8 is a diagram illustrating a fourth configuration example of the pressure variation suppressor according to the embodiment.

FIG. 8 illustrates the fourth configuration example of the present embodiment. The pressure variation suppressor 32C illustrated in FIG. 8 is obtained by adding an ink detector 37 to the configuration of the pressure variation suppressor 32A described above with reference to FIG. 6.

The ink detector 37 is, for example, a liquid leakage detection sensor using an inter-electrode resistance detection method, and outputs a detection signal to the controller 40 when detecting liquid leakage.

More specifically, when the ink I (liquid) comes into contact with two electrodes (not illustrated) as the liquid leakage detection band in the liquid leakage detection sensor, a current flows through the ink I, whereby the liquid leakage detection sensor can detect that the ink flows out to the non-storage chamber C2 and that the flexible film 34 is broken.

Note that the ink detector 37 is not limited to have the above configuration, and may have a configuration using any other various methods capable of detecting the ink I flowing out to the non-storage chamber C2, such as an LED light absorption method.

The ink detector 37 described above has a function of detecting the liquid in the non-storage chamber C2, and corresponds to the "liquid detector" of the present invention.

The ink detector 37 is disposed on the bottom surface of the casing defining the non-storage chamber C2 such that the liquid leakage detection sensor described above is located in the non-storage chamber C2. In other words, the ink detector 37 is disposed on a lower surface along the direction of gravitational force among the surfaces of the casing defining the non-storage chamber C2. With such an arrangement, it is possible to more reliably detect breakage of the flexible film 34.

More specifically, an opening is formed in the bottom surface of the casing, and the ink detector 37 is fitted and fixed in the opening. Thus, the non-storage chamber C2 is sealed.

The configuration in which the non-storage chamber C2 is sealed as described above can effectively prevent the ink I flowing into the non-storage chamber C2 from flowing to the outside and contaminating each component, even when the flexible film 34 is broken. The pressure variation suppressor 32C illustrated in FIG. 8 has the abovementioned configuration as a basic configuration, and is further provided with the ink detector 37. Thus, it can immediately detect the ink I flowing into the non-storage chamber C2 due to the breakage of the flexible film 34.

In general, according to the pressure variation suppressor 32C according to the fourth configuration example, it is possible to quickly respond to the breakage of the flexible film 34 and to repair or replace the flexible film 34 at an appropriate time. Therefore, the damage of the spring 36 caused by the ink I contacting the spring 36 can be minimized.

The abovementioned configuration examples illustrated in FIG. 5A to FIG. 8 have been described on the assumption that the non-storage chamber C2 is used as a sealed space. On the other hand, in an image forming apparatus or the like that uses the ink I, such as a UV curable ink, by heating the ink I, gas in the non-storage chamber C2 expands due to the heat of the ink I, and the balance between the liquid pressure and the air pressure is not maintained. This leads to a problem of deterioration in performance of the flexible film 34 as a damper.

Figure 9:
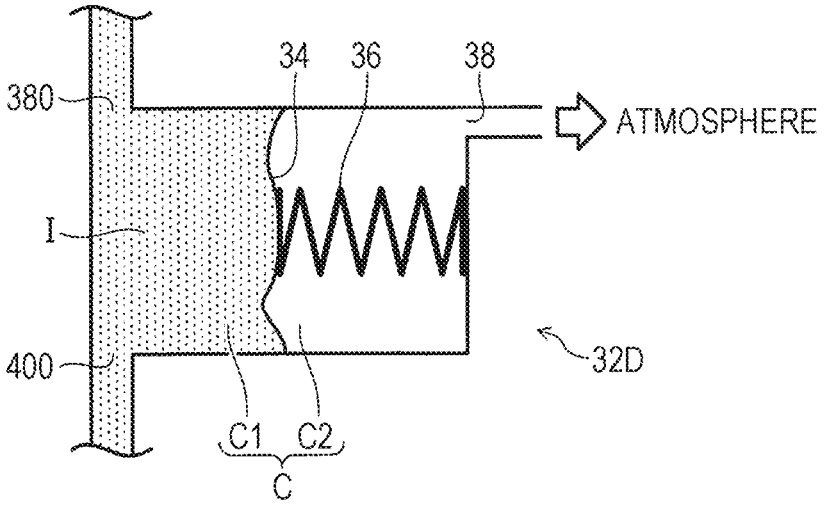
FIG. 9 is a diagram illustrating a fifth configuration example of the pressure variation suppressor according to the embodiment.

FIG. 9 illustrates a fifth configuration example of the present embodiment for addressing the above problem. The pressure variation suppressor 32D illustrated in FIG. 9 has a configuration similar to the configuration of the pressure variation suppressor 32A described with reference to FIG. 6, except that a communication hole 38 communicating with the atmosphere is provided in the casing so as not to seal the non-storage chamber C2.

According to the pressure variation suppressor 32D of the fifth configuration example, even when the heated ink I such as the UV curable ink flows and the gas in the non-storage chamber C2 expands, the expanded gas can be released to the outside through the communication hole 38 of the casing.

Therefore, according to the pressure variation suppressor 32D, it is possible to effectively prevent the damper effect of the flexible film 34 from being impaired due to the variation in air pressure in the non-storage chamber C2.

The position of the communication hole 38 provided in the casing is not particularly limited as long as the circulation between the gas in the non-storage chamber C2 and the outside air can be achieved. However, if the communication hole 38 is provided in the bottom surface or in the lower part of the wall of the casing, the ink I flowing into the non-storage chamber C2 immediately flows out to the outside to possibly cause a problem such as contamination of components in the image forming apparatus, when the flexible film 34 is broken.

Therefore, in consideration of the above problem, it is desirable to provide the communication hole 38 as high as possible in the wall surface that defines the non-storage chamber C2 as illustrated in FIG. 9. With such a configuration, even when, for example, the flexible film 34 is broken and the ink I flows into the non-storage chamber C2, the ink I can be prevented from flowing out to the outside through the communication hole 38.

The first to fifth configurations described above in FIG. 5A to FIG. 9 can be appropriately combined according to cost, the type of ink I to be used, and the like.

For example, the ink detector 37 illustrated in FIG. 8 may be added to the pressure variation suppressor 32D described above with reference to FIG. 9.

This configuration can provide the effect of normally exhibiting the damper effect of the flexible film 34 regardless of the temperature of the ink I and the like. Further, when the flexible film 34 is broken and the ink I flows into the non-storage chamber C2, this configuration can immediately detect the occurrence of an abnormality in the flexible film 34.

Therefore, according to such a configuration, it is easy to take measures such as closing a solenoid valve (not illustrated) disposed in the ink flow path before the ink I flows out to the outside through the communication hole 38. Furthermore, if the above measures can be taken before the ink I comes into contact with the spring 36 in the non-storage chamber C2, the damage of the spring 36 can be minimized.

Figure 10:
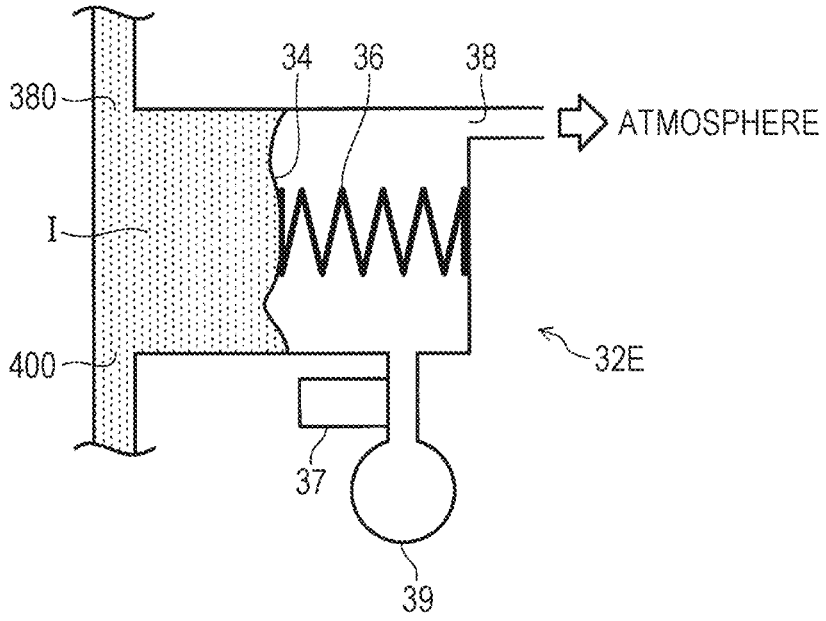
FIG. 10 is a diagram illustrating a sixth configuration example of the pressure variation suppressor according to the embodiment.

FIG. 10 illustrates the sixth configuration example of the present embodiment. The pressure variation suppressor 32E illustrated in FIG. 10 is obtained by adding an ink collector 39 to the configuration of the pressure variation suppressor 32D described above with reference to FIG. 9, and further providing the ink detector 37 shown in FIG. 8 in an ink flow path of the ink collector 39.

The ink collector 39 collects the ink I flowing into the non-storage chamber C2 due to the breakage of the flexible film 34. Therefore, the ink collector 39 is provided below the pressure variation suppressor 32E in the direction of gravitational force as illustrated in FIG. 10. In addition, the ink flow path of the ink collector 39 is provided so as to communicate with the bottom surface of the casing that defines the non-storage chamber C2.

With such a configuration, it is possible to avoid or prevent problems such as deterioration of durability of the spring 36 due to contact between the ink I flowing into the non-storage chamber C2 and the spring 36.

The ink collector 39 can be configured as a container (storage tank) that stores the ink I flowing into the non-storage chamber C2. In this case, it is preferable that the container has a sufficiently large capacity from the viewpoint of gaining as much time as possible until the ink I flowing into the non-storage chamber C2 comes into contact with the spring 36 as described above.

Alternatively, as will be described later with reference to FIG. 11, the ink collector 39 may have a piping configuration for returning the ink I flowing into the non-storage chamber C2 to the ink tank on the upstream side.

Figure 11:
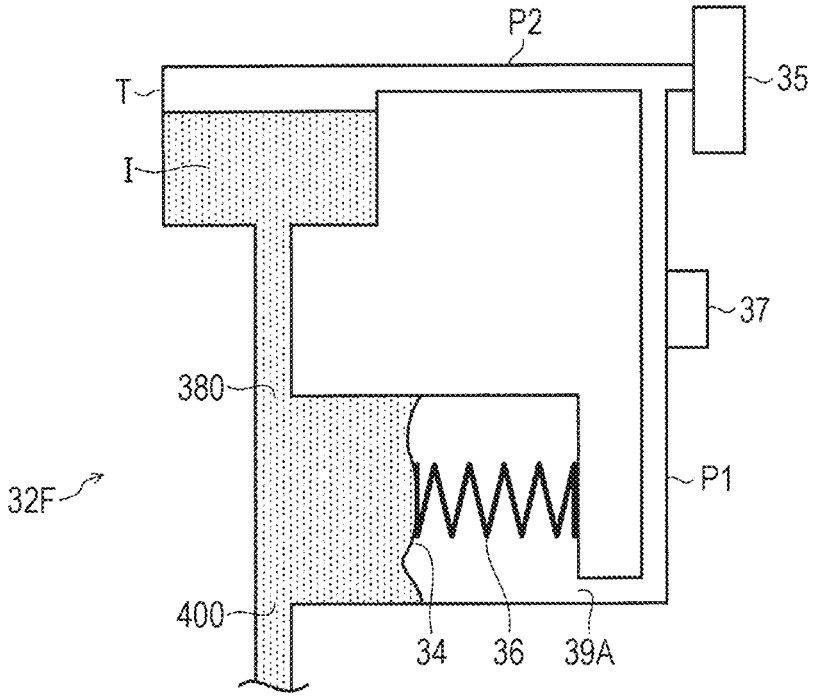
FIG. 11 is a diagram illustrating a seventh configuration example of the pressure variation suppressor according to the embodiment.

FIG. 11 illustrates the seventh configuration example of the present embodiment. The pressure variation suppressor 32F illustrated in FIG. 11 is obtained by adding an ink collector 39A for returning the ink I flowing into the non-storage chamber C2 to the upstream ink tank T to the configuration of the pressure variation suppressor 32A described above with reference to FIG. 6.

In FIG. 11, the ink tank T is a main tank located at the most upstream side in the ink flow path, and corresponds to the "liquid storage tank" of the present invention. For the sake of simplicity, in FIG. 11, a pipe communicating with the bottom surface of the ink tank T is directly connected to the inlet 380 of the pressure variation suppressor 32F, but in actual operation, an intermediate tank, a valve body, a pump, and the like may be interposed between the ink tank T and the pressure variation suppressor 32F.

In the configuration example shown in FIG. 11, a pipe P1 which constitutes a part of the ink collector 39A and communicates with the bottom (bottom surface) of the pressure variation suppressor 32F and a pipe P2 for regulating air pressure which communicates with the upper part of the ink tank T communicate with each other to form a closed circuit for regulating air pressure.

Furthermore, in the configuration example shown in FIG. 11, the pressure adjuster 35 described above with reference to FIG. 7 and the ink detector 37 described above with reference to FIG. 10 are disposed in the closed circuit.

It is to be noted that the pressure adjuster 35 illustrated in FIG. 11 is controlled by the controller 40 so as to allow the air in the closed circuit, that is, the air in the ink tank T and the non-storage chamber C2, to have a common negative pressure. The pressure adjuster 35 and the controller 40 in the pressure variation suppressor 32F have a function of generating a common negative pressure in the ink tank T (eventually, storage chamber C1) and the non-storage chamber C2, and correspond to the "negative pressure generator" of the present invention.

Thus, the pipes P1 and P2 have a function of communicating the pressure adjuster 35 (negative pressure generator) and the non-storage chamber C2.

The pressure adjuster 35 (negative pressure generator) is provided at a position above the liquid level of the ink I in the ink tank T in order not to suction the ink I which flows into the non-storage chamber C2 and the pipe P2 due to the breakage of the flexible film 34.

Thus, the pressure adjuster 35 (negative pressure generator) generates a negative pressure in the non-storage chamber C2 in a normal use state to move the central part of the flexible film 34 toward the non-storage chamber C2, and slackens the flexible film 34 by balance with the pressing force of the spring 36.

Furthermore, the pressure variation suppressor 32F can maintain the meniscus of the ink I in the vicinity of the nozzle of the inkjet head 242 by applying a negative pressure to the ink I, and slacken the flexible film 34 by generating the common negative pressure in the ink I and the non-storage chamber C2.

Thus, in the pressure variation suppressor 32F of the seventh configuration example, the pressure adjuster 35 (negative pressure generator) is shared by the ink flow path and the closed circuit in which the negative pressure is also applied to the storage chamber C1, so that the configuration can be simplified as a whole. Furthermore, in the pressure variation suppressor 32F, the force pressing the flexible film 34 from the storage chamber C1 side is only the force due to the water head difference from the liquid level of the ink tank T to the flexible film 34, and thus the spring 36 can be easily designed or adjusted.

For easy understanding, in the configuration example shown in FIG. 11, the ink detector 37 is located at a high position (pipe P1) up to the vicinity of the upper limit position. In actual operation, the ink detector 37 can be provided at a lower position of the pipe P1 or the position described above in FIG. 8 from the viewpoint of detecting the outflow of the ink I to the non-storage chamber C2 earlier.

On the other hand, if the ink detector 37 is provided at a position higher than the position illustrated in FIG. 11, particularly, above the liquid level of the ink I in the ink tank T in the direction of gravitational force, the ink I flowing into the non-storage chamber C2 and the pipe P2 due to the breakage of the flexible film 34 cannot be detected.

Therefore, the ink detector 37 is desirably provided at least at a position corresponding to a state where the liquid level of the ink I in the ink tank T is the lowest, that is, below the bottom surface of the ink tank T in the direction of gravitational force as shown in FIG. 11.

As described above in detail, the present embodiment is provided with: a liquid flow chamber C through which ink I (liquid) flows, the liquid flow chamber C having an inlet 380 through which the ink I flows in and an outlet 400 through which the ink I flows out; and a flexible film 34 that partitions the liquid flow chamber C into a storage chamber C1 in which the ink I is stored and a non-storage chamber C2 in which the ink I is not stored, wherein the flexible film 34 is slack in a state where the ink I flows through the liquid flow chamber C (storage chamber C1).

The pressure variation suppressors 32 and 32A to 32F according to the present embodiment having such a configuration have a simple configuration and can effectively suppress a variation in liquid pressure by normally exhibiting the damper function even when a heated liquid is used.

Although embodiments of the present invention have been described and illustrated in detail, the disclosed embodiments are made for purposes of illustration and example only and not limitation. In other words, the present invention can be implemented in various modes without departing from the spirit or main features of the present invention. The scope of the present invention should be interpreted by terms of the appended claims.

What is claimed is:

1. A pressure variation suppressor comprising:

a liquid flow chamber through which liquid flows, the liquid flow chamber having an inlet through which the liquid flows in and an outlet through which the liquid flows out; and a flexible film that partitions the liquid flow chamber into a storage chamber in which the liquid is stored and a non-storage chamber in which the liquid is not stored, wherein the flexible film is slack in a state where the liquid flows through the liquid flow chamber;

a second hardware processor that generates a negative pressure in the non-storage chamber; a pipe that connects the non-storage chamber and the second hardware processor; a liquid detector that detects the liquid in the pipe; and a liquid storage tank that communicates with an upstream side of the inlet in a flowing direction of the liquid, wherein the second hardware processor generates a negative pressure common to the liquid storage tank and the non-storage chamber.

2. The pressure variation suppressor according to claim 1, further comprising a first hardware processor that biases the flexible film toward the storage chamber.

3. The pressure variation suppressor according to claim 2, wherein the flexible film is tight with no slack by a biasing force of the first hardware processor in a state where the liquid is not stored in the storage chamber.

4. The pressure variation suppressor according to claim 2, wherein the first hardware processor is a pressing member that is disposed in the non-storage chamber and presses the flexible film.

5. The pressure variation suppressor according to claim 4, wherein the pressing member is a spring disposed to press a center of the flexible film.

6. The pressure variation suppressor according to claim 2, wherein the first hardware processor is a pressure adjuster that biases the flexible film toward the storage chamber by adjusting a pressure in the non-storage chamber.

7. The pressure variation suppressor according to claim 1, wherein the non-storage chamber is sealed.

8. The pressure variation suppressor according to claim 1, further comprising a liquid detector that detects the liquid in the non-storage chamber.

9. The pressure variation suppressor according to claim 8, wherein the liquid detector is disposed on a lower surface along a direction of gravitational force among surfaces defining the non-storage chamber.

10. The pressure variation suppressor according to claim 1, wherein a communication hole communicating with atmosphere is provided in a surface defining the non-storage chamber in the storage chamber.

11. The pressure variation suppressor according to claim 10, further comprising:

an ink collector disposed on a lower surface along a direction of gravitational force among surfaces defining the non-storage chamber; and a liquid detector that detects the liquid flowing into the ink collector.

12. The pressure variation suppressor according to claim 1, wherein the liquid detector that detects the liquid in the pipe is disposed below a bottom surface of the liquid storage tank in a direction of gravitational force.

13. An image forming apparatus comprising:

the pressure variation suppressor according to claim 1; and an image former that ejects ink supplied via the pressure variation suppressor toward a recording medium.

* * * * *